US005937377A

United States Patent [19]

Hardiman et al.

[11] Patent Number: 5,937,377

[45] Date of Patent: Aug. 10, 1999

[54] METHOD AND APPARATUS FOR UTILIZING NOISE REDUCER TO IMPLEMENT VOICE GAIN CONTROL AND EQUALIZATION

[75] Inventors: Budi Agung Hardiman; Koji Kimura, both of San Diego, Calif.

[73] Assignees: Sony Corporation, Tokyo, Japan; Sony Electronics, Inc., San Diego, Calif.

[21] Appl. No.: 08/804,024

[22] Filed: Feb. 19, 1997

[51] Int. Cl.[6] ..... G10L 9/00

[52] U.S. Cl. ..... 704/225; 704/226

[58] Field of Search ..... 704/219, 225, 704/226, 233, 227, 228; 381/94.1, 94.2, 94.3, 94.7

[56] References Cited

U.S. PATENT DOCUMENTS

| | | | |
|---|---|---|---|
| 4,628,529 | 12/1986 | Borth et al. | 381/94 |
| 4,630,305 | 12/1986 | Borth et al. | 381/94 |
| 4,811,404 | 3/1989 | Vilamar et al. | 381/94 |
| 5,012,519 | 4/1991 | Adlersberg et al. | 381/94.3 |
| 5,148,488 | 9/1992 | Chen et al. | 704/219 |
| 5,659,622 | 8/1997 | Ashley | 381/94 |

*Primary Examiner*—Richemond Dorvil
*Attorney, Agent, or Firm*—Limbach & Limbach LLP; Seong-Kun Oh

[57] ABSTRACT

A signal pre-processing apparatus for processing signal such that the signal is selectively adjusted for gain and equalization based upon a plurality of parameters predetermined by a noise reducing means. The present invention is a method and apparatus for substantially reducing undesirable noise components of speech signals in speech processing without necessitating added hardware, complexity, or sacrifice in speech signal integrity. In particular, background noise is reduced by means of frequency transformation and modification thus greatly enhancing speech quality without significantly affecting the reconstructed speech. By estimating the noise spectrum continuously from the input signal, the present invention permits modification of the frequency response of the input signal thus reducing the effect of the noise components of the input signal.

32 Claims, 9 Drawing Sheets

METHOD AND APPARATUS FOR UTILIZING NOISE REDUCER TO IMPLEMENT VOICE GAIN CONTROL AND EQUALIZATION

BACKGROUND OF THE INVENTION

1. Field of the Invention

The present invention relates to speech pre-processing method and apparatus apparatus and techniques for digital communication systems. More specifically, the present invention relates to using noise reduction parameters to adjust gain and frequency response of speech signals in Personal Communication Service (PCS) systems.

2. Description of the Related Art

Multiple access in digital communication systems has numerous important practical applications. However, presently available multiple access techniques require that the message corresponding to different users be separated in some manner such that they do not interfere with one another. Generally, this can be achieved by dividing the signal in time or frequency domain. Then, different signals can be separated out by using some form of matched filtering or its equivalent which responds to only a single signal because of the orthogonality of the signals.

There are several ways to achieve signal division of two or more signals. The messages can be separated in time, insuring that different users transmit at different times, in frequency, insuring that the different users use different frequency bands, or, the message can be transmitted at the same time and at the same frequency, but made orthogonal by some other means, such as code division in which the users transmit signals which are guaranteed to be orthogonal through the use of specially designed codes.

Code Division Multiple Access (CDMA) has been the prevailing choice in systems for cellular communication. CDMA allows multiple access by using code sequences as traffic channels in a common transmission channel. By contrast, Time Division Multiple Access (TDMA) requires dividing a transmission channel into many time slots where each slot carries a traffic channel. Also, there is Frequency Division Multiple Access (FDMA) which allows multiple access by dividing an allocated spectrum into different transmission channels. For example, a spectral bandwidth of 1.2 MHz can be divided into 120 transmission channels with a channel bandwidth of 10 kHz. This is a FDMA scheme. A spectral bandwidth of 1.2 MHZ can also be divided into 40 transmission channels with a radio channel bandwidth of 30 kHz but each radio channel carries three time slots. Therefore, a total of 120 time-slot channels are obtained. This is a TDMA scheme. Finally, a spectral bandwidth of 1.2 MHz can also be used as one transmission channel but provide 40 code-sequence traffic channels for each sector of a cell. A cell of three sectors has a total of 120 traffic channels. This is an example of a CDMA scheme. Therefore, in using CDMA communications, the frequency spectrum can be reused multiple times, permitting an increase in system user capacity. The use of CDMA results in a much higher spectral efficiency than can be achieved by using other multiple access techniques.

Currently, there are three industry standards in the CDMA technology which implement voice compression. The CDMA standard, Telecommunication Industry Association-Interim Standard 96 (TIA-IS96), uses "QCELP", "Pure Voice", and IS-127, otherwise known as Enhanced Variable Rate Coder (EVRC) as the three voice compression standards. Of the three standards, only IS-127 has a noise reducing standard. This standard is widely used by digital transmission devices and techniques. A noise reducer (NR) performs noise processing in frequency domain by adjusting the level of the frequency response of each frequency band which results in substantial reduction in background noise without affecting signal integrity.

FIG. 1 illustrates a block diagram of a conventional noise reducer operating at 10 ms frame interval. This noise reducer primarily improves the signal-to-noise ratio (SNR) of the input signal before beginning of speech encoding by operation of the following processes.

Original speech S(n) is passed through a high pass filter 100 which removes unnecessary low frequency noise. The high pass filter 100 initializes filter memory to all zeros, and thereafter filtering takes place in the form of a sixth order Butterworth filter implemented as three cascaded biquadratic sections with a cutoff frequency at 120 Hz.

At frequency domain conversion stage 101, a high pass filtered input signal $S_{HP}(n)$ is windowed using a smoothed trapezoid window, in which a first D samples of an input frame buffer d(m) (m=current frame) are overlapped from a last D samples of a previous frame d(m−1). In other words, for a sample index n with the input frame buffer d(m) having a frame length L of 80, the overlap in samples is given by the following expression.

$$d(m, n)=d(m-1, L+n);\ \text{for } 0\leqq n<D \tag{1}$$

The remaining samples (i.e., the non-overlapping portions) of the input frame buffer d(m) are then pre-emphasized at the frequency domain conversion stage 101 to increase the high to low frequency ratio with a pre-emphasis factor ζ (here, set at −0.8) according to the following expression $$d(m, D+n)=S_{HP}(n)+\zeta_P\, S_{HP}(n-1);\ \text{for } i\leqq n<L \tag{2}$$

This results in the input frame buffer d(m) containing L+D=104 samples in which the first D samples are the pre-emphasized overlap from the previous frame (m−1), and the subsequent L samples are the input from the current frame m.

Next, a smoothed trapezoidal window is applied to the input frame buffer d(m) to form a discrete fourier transform (DFT) data buffer g(n). Thereafter, a transformation of discrete fourier transform data buffer g(n) into frequency domain is performed using DFT to obtain the data buffer in frequency domain G(k).

A conventional transform technique such as a 64-point complex Fast Fourier Transform (FTT) is used to convert the time domain data buffer g(n) to the frequency domain data buffer spectrum G(k). For details on this technique, see Proakis et al., "Introduction to Digital Signal Processing," New York, Macmillan, pp. 721–722 (1988). The resulting spectrum G(k) is used to compute noise reduction parameters for the remaining blocks as explained below.

The frequency domain data buffer spectrum G(k) resulting from the frequency domain conversion 101 is used to estimate channel energy $E_{ch}(m)$ for the current frame m at channel energy estimator stage 102. Here, 64 point energy bands are computed from the FFT results of stage 101, and are quantized into 16 bands (or channels). The quantization is used to combine low, mid, and high frequency components and to simplify the internal computation of the algorithm. Also, in order to maintain accuracy, the quantization uses a small step size for low frequency ranges, increased the step size for higher frequencies, and uses the highest step size for the highest frequency ranges.

Thereafter, at the channel signal-to-noise ratio estimator stage 104, quantized 16 channel SNR indices $\sigma_q(i)$ are estimated using the channel energy $E_{ch}(m)$ from the channel energy estimator stage 102, and current channel noise energy estimate $E_n(m)$ from a background noise estimator 109 which continuously tracks the input spectrum G(K), and whose operations will be explained shortly. In order to avoid undervaluing and overvaluing of the SNR, the final SNR result is also quantized at the channel SNR estimator 104. Then, a sum of voice metrics v(m) at stage 105 is determined based upon the estimated quantized channel SNR indices $\sigma_q(i)$ from the channel SNR estimator stage 104. This involves transformation of the actual sum of all 16 signal-to-noise ratio from a predetermined voice metric table with the quantized channel SNR indices $\sigma_q(i)$. The higher the SNR, the higher the voice metric sum v(m). Because the value of the voice metric v(m) is also quantized, the maximum and the minimum values are always ascertainable.

Then, at spectral deviation estimator stage 108, changes from speech to noise and vice versa are detected which can be used to indicate the presence of speech activity of a noise frame. In particular, a log power spectrum $E_{db}$ (m, i) is estimated based upon the estimated channel energy $E_{ch}(m)$ (from stage 102) for each of the 16 channels. Then, an estimated spectral deviation $\Delta_E(m)$ between a current frame power spectrum $E_{db}(m)$ and an average long-term power spectral estimate $E_{db}(m)$ is determined. The estimated spectral deviation $\Delta_E(m)$ is simply a sum of the difference between the current frame power spectrum $E_{db}(m)$ and the average long-term power spectral estimate $E_{db}(m)$ at each of the 16 channels. In addition, a total channel energy estimate $E_{TOT}(m)$ for the current frame is determined by taking the logarithm of the sum of the estimated channel energy $E_{ch}(m)$ at each frame. Thereafter, an exponential windowing factor $\alpha(m)$ as a function of the total channel energy $E_{TOT}(m)$ is determined, and the result of that determination is limited to a range determined by a predetermined upper and lower limits $\alpha_H$ and $\alpha_L$, respectively. Then, an average long-term power spectral estimate for the subsequent frame $E_{db}(m+1, i)$ is updated using the exponential windowing factor $\alpha(m)$, the log power spectrum $E_{db}(m)$, and the average long-term power spectral estimate for the current frame $E_{db}(m)$.

With the above variables determined at the spectral deviation estimator stage 108, noise estimate is updated at noise update decision stage 107. Broadly, speaking at the noise update decision stage 107, a noise frame indicator (update_flag) indicating the presence of a noise frame can be determined by utilizing the voice metrics v(m) from the voice metric calculation stage 105, and the total channel energy $E_{TOT}(m)$ and the spectral deviation $\Delta_E(m)$ from the spectral deviation estimator stage 108. Using these three pre-computed values coupled with a simple delay decision mechanism, the noise frame indicator (update_flag) is ascertained.

The delay decision is implemented using counters and a hysterisis process to avoid any sudden changes in the noise to non-noise frame detection.

FIG. 1A illustrates the detailed steps for updating the noise estimate. Initially at step 130, the noise frame indicator is initialized such that it does not indicate a noise frame (i.e., update_flag=False). Then, if the voice metric sum v(m) is determined to be less or equal to a predetermined update threshold level (UPDATE_THLD) at step 131, the noise frame indicator is initialized to indicate a noise frame (update_flag=True), and a background noise update counter is initialized (update_cnt=0) at step 132. Here, the predetermined update threshold level (UPDATE_THLD) is adjusted at a value of 35.

If the voice metric v(m) is above the predetermined update threshold level (UPDATE_THLD), the update logic is forced at step 133. In other words, at step 133, it is determined whether the total channel energy $E_{tot}(m)$ is greater than a predetermined noise floor level (NOISE_FLOOR_DB), and further, whether the spectral deviation $\Delta_E(m)$ is below a predetermined deviation threshold level (DEV_THLD). Here, the predetermined deviation threshold level (DEV_THLD) is set at a value of 28.

If the total channel energy $E_{tot}(m)$ is greater than the predetermined noise floor level (NOISE_FLOOR_DB), and further, if the spectral deviation $\Delta_E(m)$ is below the predetermined deviation threshold level (DEV_THLD), the background noise update counter is incremented by one (update_cnt+1) at step 134. Then, at step 135, the background noise update counter (update_cnt) is compared with a background noise update counter threshold level (UPDATE_CNT_THLD) which is set at 50. If it is determined that the update counter is greater than or equal to the background noise update counter threshold level, the noise frame indicator indicates a noise frame (update_flag=True) at step 136.

Furthermore, to prevent long term creeping of the background noise update counter (update_cnt), the hysterisis process is implemented as follows. If and only if the background noise update counter (update_cnt) is equal to a previous update counter (last_update_cnt), a hysterisis counter (hyster_cnt) is increased by one (hyster_cnt+1). Otherwise, the hysterisis counter (hyster_cnt) is initialized to zero.

Then, a previous update counter (last_update_cnt) is initialized to the current background noise update counter (update_cnt), and then, the hysterisis counter (hyster_cnt) is compared with a predetermined hysterisis counter threshold level (HYSTER_CNT_THLD) which is set at 6. If the hysterisis counter (hyster_cnt) is larger, then the background noise update counter (update_cnt) is set to zero. In other words, the hysterisis process is implemented only if the hysterisis counter (hyster_cnt) falls below the threshold level (HYSTER_CNT_THLD).

Referring back to FIG. 1, having updated the background noise at stage 107, it is determined whether channel signal-to-noise ratio modification is necessary and to modify the appropriate channel SNR indices $\sigma_q(i)$ at channel gain calculation stage 110. In some instances, it is necessary to modify the SNR value to avoid classifying a noise frame as speech. This error may stem from distorted frequency spectrum. By analyzing the mid and high frequency bands at a channel SNR modifier stage 106, the pre-computed SNR can be modified if it is determined that a high probability of error exists in the processed signal. The above-described process is illustrated in FIG. 1B and explained below.

In order to initially set or reset a channel SNR modification flag (modify_flag) which indicates whether modification is necessary, an index counter (index_cnt) is initialized (index_cnt=0) at step 150. Then a simple iteration is implemented from steps 151 to 156, and another from steps 157 through 165.

More particularly, for a channel frequency index $i=N_M$ to $N_c-1$, (where $N_c$=number of channels which is set at 16 in this case, and $N_M=5$), the following steps are taken. At step 152, the quantized channel SNR indices $\sigma_q(i)$ determined at the channel SNR estimator 104 (FIG. 1) are verified to be greater or equal to a predetermined channel SNR index threshold level (INDEX_THLD) which is set at 12. Then the index counter (index_cnt) is incremented by one (index_cnt+1) at step 153. Thereafter, at step 154, it is determined whether the index counter (index_cnt) is less than a predetermined index counter threshold level (INDEX_CNT_THLD) set at 5. If the index counter (index_cnt) is less than the predetermined threshold level (INDEX_CNT_THLD), a channel SNR modification flag (modify_flag) indicates that modification of the channel SNR is necessary (modify_flag=True) at step 155. Otherwise, at step 156, the modification flag (modify_flag) indicates that the modification is not necessary (modify_flag=False), and the modified channel SNR indice $\sigma'_q(i)$ are not changed from the original values ($\sigma'_q(i)=\sigma_q(i)$) at step 163.

If channel SNR modification is necessary (i.e., modify_flag=True) as determined at steps 150 to 156, the channel SNR indices $\sigma_q(i)$ are modified to obtain modified channel SNR indices $\sigma'_q(i)$ at step 163. In other words, if and only if the modification flag (modify_flag) indicates that modification is necessary (modify_flag=True), an iterative process (steps 157–162 and 165) takes place for each of the 16 channels (i.e., for i=0 to $N_c-1$).

If the voice metric sum v(m) determined at the voice metric calculation stage 105 (FIG. 1) is determined to be less than or equal to a predetermined metric threshold level (METRIC_THLD), or if the channel SNR indices $\sigma_q(i)$ are less than or equal to a predetermined setback threshold level (SETBACK_THLD) at step 158, the modified channel SNR indices $\sigma'_q(i)$ are set to one at step 159. Here, the predetermined metric threshold level (METRIC_THLD) is set at 45, while the predetermined setback threshold level (SETBACK_THLD) is set at 12. Otherwise, the modified channel SNR indices $\sigma'_q(i)$ are not changed from the original values ($\sigma'_q(i)=\sigma_q(i)$) at step 165.

Thereafter, to limit the modified channel SNR indices $\sigma_q$ above a predetermined channel SNR threshold level $\sigma_{th}$ (adjusted at 6 here), another iteration is implemented (for i=1 to Nc−1) where it is first determined at step 160 whether the modified channel SNR indices $\sigma'_q(i)$ are less than the predetermined channel SNR threshold level $\sigma_{th}$. If so, the threshold limited, modified channel SNR indices $\sigma''_q(i)$ are set to the predetermined channel SNR threshold level $\sigma_{th}$ ($\sigma''_q(i)=\sigma_{th}$) at step 162. Otherwise, the threshold limited, modified channel SNR indices $\sigma''_q(i)$ are not changed from the modified channel SNR indices $\sigma'_q(i)$ (i.e., $''_q(i)=\sigma'_q(i)$) at step 161.

Referring to FIG. 1, the threshold limited, modified channel SNR indices $\sigma''_q(i)$ are provided to the channel gain calculation stage 110 to determine an overall gain factor $\gamma_n$ for the current frame based upon a pre-set minimum overall gain $\gamma_{min}$, a noise floor energy $E_{floor}$, and the estimated noise spectrum of the previous frame $E_n(m-1)$. Channel gain $\gamma_{db}$ (i) (in decibels), determined with a preset gain slope $\mu_g$ and based upon the overall gain factor $\gamma_n$, the predetermined channel SNR threshold value $\sigma_{th}$ and the threshold limited, modified channel SNR indices $\sigma''_q$ (i), is then converted to linear channel gains $\gamma_{ch}(i)$ by taking the inverse logarithm of base 10. The linear channel gains $\gamma_{ch}(i)$ are then applied to the transformed input signal G(k) by a gain adjuster 103 (FIG. 1) resulting in a noise-reduced signal spectrum H(k). This noise reduced signal spectrum H(k) is then converted into time domain at time domain conversion stage 111 (FIG. 1) producing a time domain noise reduced signal s'(n).

It should be noted that the channel noise energy estimate $E_n(m)$ for the subsequent frame (m+1) is updated if and only if the noise frame indicator indicates a noise frame (update_flag=True). The updating is carried out based upon a predetermined minimum allowable channel energy $E_{min}$, and a channel noise smoothing factor $\alpha_n$. Also, the channel noise energy estimate $E_n(m)$ is initialized to the channel noise energy $E_n(m)$ of the first frame, that is, where m=1.

A trade-off exists between the maximum noise reduction effect and the quality of the reconstructed speech. As in the channel energy estimator stage 104, to maintain accuracy in performing the inverse quantization to generate 64 gain values from the 16 channel gains, small step sizes are used for low frequency ranges, step size is increased for higher frequencies, and the highest step is used for the highest frequencies. Depending upon the result from the noise update decision stage 107, the current frequency spectrum G(k) is classified as either noise or speech. If the noise frame indicator (update_flag) at the noise update decision stage 107 indicates a noise frame, then the current frequency spectrum G(k) is used and saved for estimating the noise characteristics of the environment in the background noise estimator stage 109.

Under ideal conditions, that is, where neither background noise nor other noise sources exist, a noise reducer is unnecessary. However, since background noise is always present, and therefore, the noise reducer, it would be desirable to be able to control the gain and the frequency response of the voice signal using the already existing parameters of the noise reducer. One approach has been to modify the hardware of the front-end analog circuit. However, this requires additional components which necessarily increases complexity as well as providing another potential source for noise. Therefore, it would be desirable to have a speech signal pre-processing system where the signal gain and its frequency response can be adjusted without adding hardware modification or increase in complexity.

SUMMARY OF THE INVENTION

It is one object of the present invention is to provide a system which allows utilization of noise reducer parameters to control signal gain and to adaptively equalize the overall signal spectrum thereby increasing signal fidelity. It is a further object of this invention to enhance speech signal pre-processing without adding hardware complexity. Specifically, the present invention extends the application of the IS-127 voice compression standard for CDMA technology to include automatic gain control and adaptive equalization.

According to one embodiment of the present invention, there is provided a method of controlling the gain of an input signal in a signal pre-processing system in accordance with a plurality of parameters generated from a noise reducer in the signal pre-processing system, the method comprising the steps of: detecting a signal frame; detecting a first frame of the input signal frequency spectrum; initializing a plurality of gain control variables after the first frame detecting step; determining an input signal energy level; adjusting a gain modification level in accordance with the input signal energy level; limiting the input signal gain in accordance with a predetermined upper gain level boundary and a predetermined lower gain boundary; comparing the gain modification level to an upper gain limit and a lower gain limit; and adjusting the input signal frame gain level in accordance with the gain modification level comparing step such that the gain modification level is maintained within a variable range.

According to another embodiment of the present invention, there is provided a method of selectively adjusting the gain of an input signal frequency spectrum for each input signal channel frequency index such that the input signal is adaptively equalized in accordance with a plurality of parameters generated from a noise reducer in a signal pre-processing system, the method comprising the steps of: initializing a plurality of equalizer variables; determining a gain ratio for each channel frequency index of the input signal in accordance with the plurality of parameters generated from the noise reducer; detecting a signal frame; detecting a first frame of the input signal; determining an input signal energy level in accordance with a predetermined smoothing factor and the gain ratio; adjusting a gain factor in accordance with the input signal energy level; limiting the gain factor in accordance with a predetermined upper gain limit and a predetermined lower gain limit such that the gain factor is limited within a variable range.

According to yet another embodiment of the present invention, there is provided a signal pre-processing system for controlling gain of an input signal in a signal pre-processing system in accordance with a plurality of parameters generated from a noise reducer in the signal pre-processing system, the gain controller comprising: a noise frame detector for detecting a noise frame in the input signal; a signal frame detector for detecting a first signal frame of the input signal in accordance with the noise frame detector detecting the noise frame, the signal frame detector further initializing a plurality of gain controller parameters; a signal energy detector for detecting an input signal energy level in accordance with the signal frame detector detecting the first signal frame the plurality of parameters from the noise reducer and a gain controller smoothing factor such that the signal energy level is adjusted; a signal frame counter for controlling the signal frame detector; and a gain modifier for generating an input signal gain modification level in accordance with the plurality of parameters from the noise reducer and the signal frame counter detecting a predetermined number of signal frames such that a gain modification level is generated.

According to another embodiment of the present invention, there is provided a signal pre-processing system for selectively adjusting the gain of an input signal frequency spectrum such that the input signal is adaptively equalized in accordance with a plurality of parameters generated from a noise reducer in the signal transmitting and receiving system, the adaptive equalizer comprising: a noise frame detector for detecting a noise frame in the input signal; a signal frame detector for detecting a first input signal frame in accordance with the noise frame detector detecting a noise frame in the input signal and further, the signal frame indicator further initializing a plurality of equalizer parameters; a signal energy detector for detecting an input signal energy level in accordance with the signal frame detector; and a gain equalizer for generating an equalization level of the input signal in accordance with the plurality of parameters from the noise reducer and the signal energy detector detecting an input signal energy level such that the gain equalization level is generated.

As can be seen from the above, in accordance with the present invention, sufficient level of background noise is attenuated while maintaining the original speech characteristics. For example, in a very quiet surrounding, the noise reduction effect is very minimal because of insignificant level of background noise as compared to the signal level itself. By contrast, where there is a high level of background noise, the noise reduction is raised to its maximum value without deteriorating the quality of the original speech. The speech and noise levels of the input signal determine the necessary amount of noise reduction, and the noise reduction variables are changed for each condition.

In short, the present invention allows substantial reduction in undesirable noise components of speech signals in speech processing techniques and apparatuses without necessitating added hardware, complexity, or sacrifice in speech signal integrity. In particular, in accordance with the present invention, background noise is reduced by means of frequency transformation and modification thus greatly enhancing speech quality without significantly affecting the reconstructed speech. By estimating the noise spectrum continuously from the input signal, the present invention permits modification of the frequency response of the input signal thus reducing the effect of the noise components of the input signal. These and other features and advantages of the present invention will be understood upon consideration of the following detailed description of the invention and the accompanying drawings.

BRIEF DESCRIPTION OF THE DRAWINGS

FIG. 3A-1 illustrates a flow chart of the computation of the current gain factor at the gain control system of FIG. 3.

FIG. 3A-2 illustrates a flow chart of the procedure for preventing gain overflow when low signal is followed by a loud signal for the gain control system of FIG. 3.

DESCRIPTION OF THE PREFERRED EMBODIMENT

Figure 2:
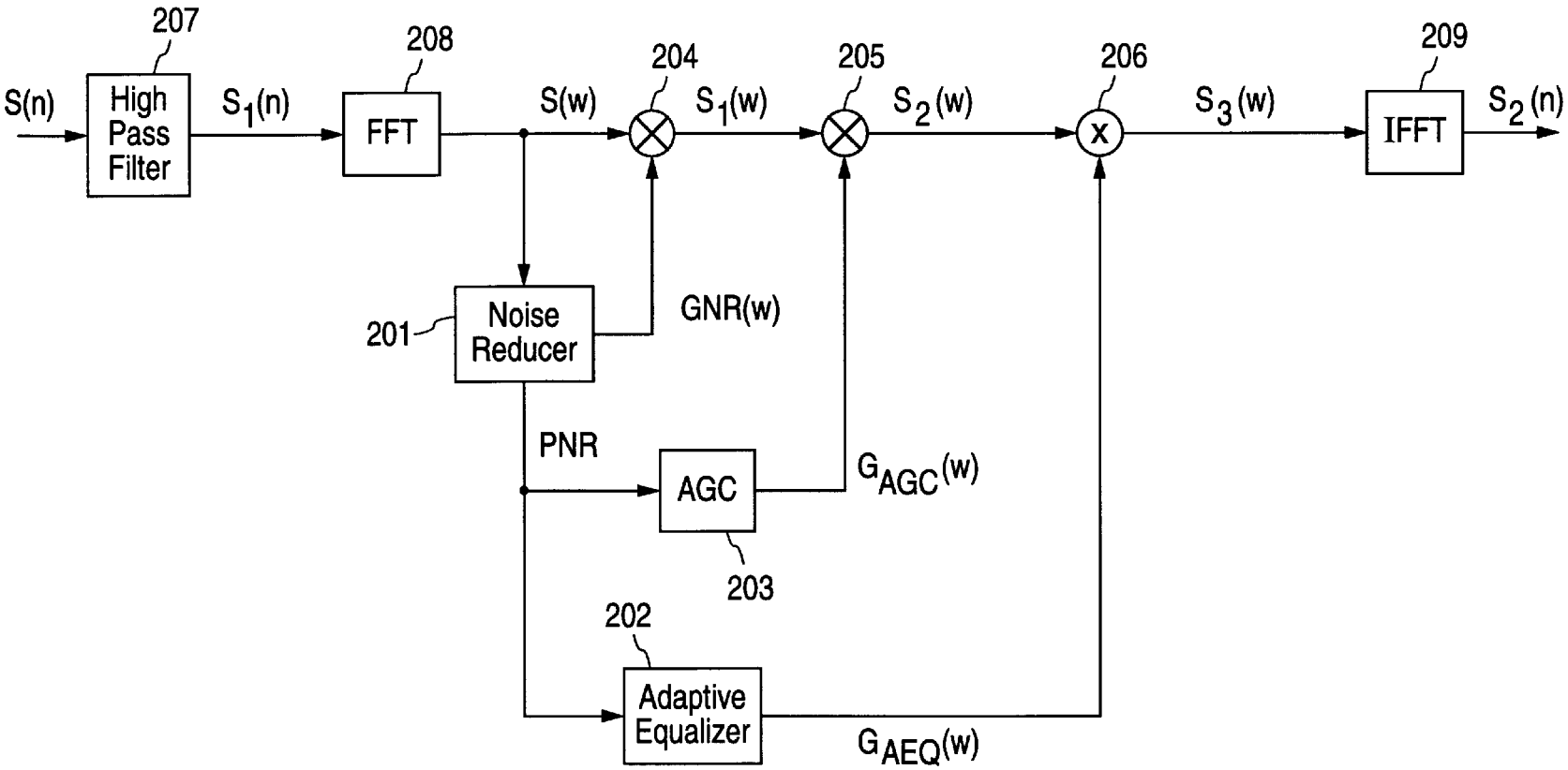
FIG. 2 illustrates a block diagram of the noise reducing system according to the present invention

FIG. 2 illustrates a noise reducing system with automatic gain control and adaptive equalizer capabilities according to the present invention. As shown, an input speech signal S(n) is high pass filtered by a High Pass Filter 207 to filter out its high frequency components $S_1(n)$. Then the high pass filtered signals $S_1(n)$ are converted into frequency domain signal S(w) by applying a conventional transform technique such as fast fourier transform processing by a Fast Fourier Transform 208 which are then provided to a conventional noise reducer. The frequency domain signal spectrum S(w) is also provided to an automatic gain control (AGC) 203 and an adaptive equalizer (AEQ) 202. The noise reducer provides noise reducer parameters $P_{NR}$ to the AGC and the AEQ. The noise reducer 201 also provides a noise reduction level parameters $G_{NR}(w)$ to a gain adjuster 204. The gain adjuster 204 adjusts the input signal S(w) in accordance with the noise reduction level parameters $G_{NR}(w)$, to provide a noise reduced signal $S_1(w)$ to another gain adjuster 205.

The AGC 203 computes an appropriate signal gain level $G_{AGC}(w)$ by estimating the current input energy with respect to a predetermined threshold level. In its estimation of the current input energy, the AGC 203 utilizes the noise reducer parameters $P_{NR}$ determined during the conventional noise reduction process. These parameters include the frame counter (frame_number), the noise frame indicator (update_flag), the total channel energy $E_{TOT}(m)$, and the current channel energy E(m,i). It should be noted that the modified gain computation by the AGC 203 is implemented only when speech signal is present.

Subsequent to the computation of the gain modification level $G_{AGC}(w)$ using the noise reducer parameters $P_{NR}$, the gain modification level $G_{AGC}(w)$ is adjusted by the gain adjuster 205 with the noise reduced input signal $S_1(w)$ to produce a noise reduced, gain controlled signal $S_2(w)$ which is then provided to yet another gain adjuster 206.

The adaptive equalizer 202 receives the noise reducer parameters $P_{NR}$ to compute a desirable equalized signal level $G_{AEQ}(W)$ as will be more fully explained below. Then, this equalizer level $G_{AEQ}(W)$ is adjusted by the gain adjuster 206 with the noise reduced, gain controlled signal $S_2(w)$ to produce a noise reduced, gain controlled, equalized signal $S_3(W)$. It should be noted that while the AGC 203 adjusts the level of all frequency bands of the input signal S(w), the AEQ 202 selectively modifies the gain of each frequency band of the input signal S(w) in accordance with the noise reducer parameters $P_{NR}$. It should be further noted that the AEQ 202 performs signal equalization only when speech signal is present. The noise reduced, gain controlled, adaptively equalized signal $S_3(W)$ is subsequently converted into time domain signal $S_2(n)$ by applying inverse fast fourier transform processing by an Inverse Fast Fourier Transform 209 for further speech processing.

Figure 3:
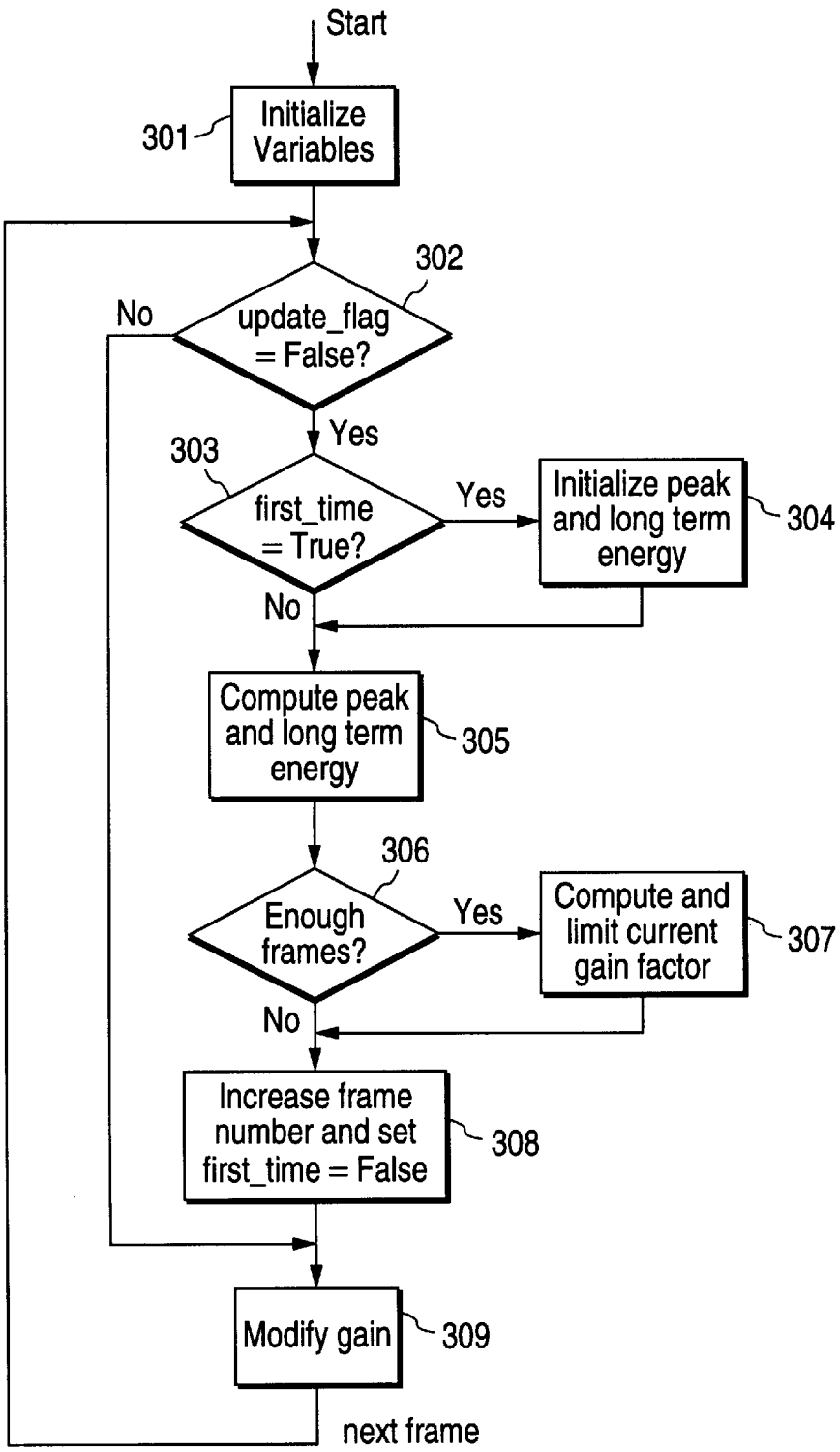
FIG. 3 illustrates a flow chart of the gain control system in the noise reducing system of FIG. 2 according to the present invention

FIG. 3 illustrates a the steps for determining the signal gain level $G_{AGC}$ using the noise reducer parameters $P_{NR}$ by the AGC 203 of FIG. 2. It is determined whether the noise frame indicator (update_flag) indicates a noise frame at step 302. If the noise frame indicator indicates a signal frame (i.e., update_flag=False), at step 303, it is determined whether the noise frame is the first frame of the signal upon power up. In other words, it is determined whether AGC variable initialization needs to take place. If the signal frame is indeed the first frame of the input signal, (i.e., an initialization variable first_time=True), then the AGC variables, peak energy $P_{Db}(m)$ and long term energy $L_{Db}(m)$ are initialized to the current total channel energy $E_{TOT}(m)$ computed by the noise reducer 201 of FIG. 2. If the noise frame is not the first signal frame (first_time=False), then at step 305, the peak energy $P_{Db}m)$ and the long term energy $L_{Db}(m)$ are determined according to the following expressions.

$$P_{Db}(m)=\alpha*P_{Db}(m)+(1-\alpha)*E_{TOT}(m) \quad (1)$$

$$L_{Db}(m)=H_{\alpha}*L_{Db}(m)+(1-H_{\alpha})*P_{Db}(m) \quad (2)$$

Where $\alpha$ is an AGC smoothing factor defined as being equal to a predetermined smoothing factor upper boundary $H_{\alpha}$ for $E_{TOT}(m)<P(m)$, and being equal to a predetermined smoothing factor lower boundary $L_{\alpha}$ for $E_{TOT}(m)\geqq P(m)$. For this embodiment of the present invention, the predetermined smoothing factor upper and lower boundaries, $H_{\alpha}$ and $L_{\alpha}$, are set to 0.995 and 0.5 respectively. For each frame m of the input signal, the peak energy $P_{Db}(m)$ in Equation (1) smooths out the total channel energy $E_{TOT}(m)$ computed by the noise reducer 201 (FIG. 2). Thereafter, the long term energy $L_{Db}(m)$ smooths out the peak energy $P_{Db}m)$ using the smoothing factor $\alpha$.

Figure 1:
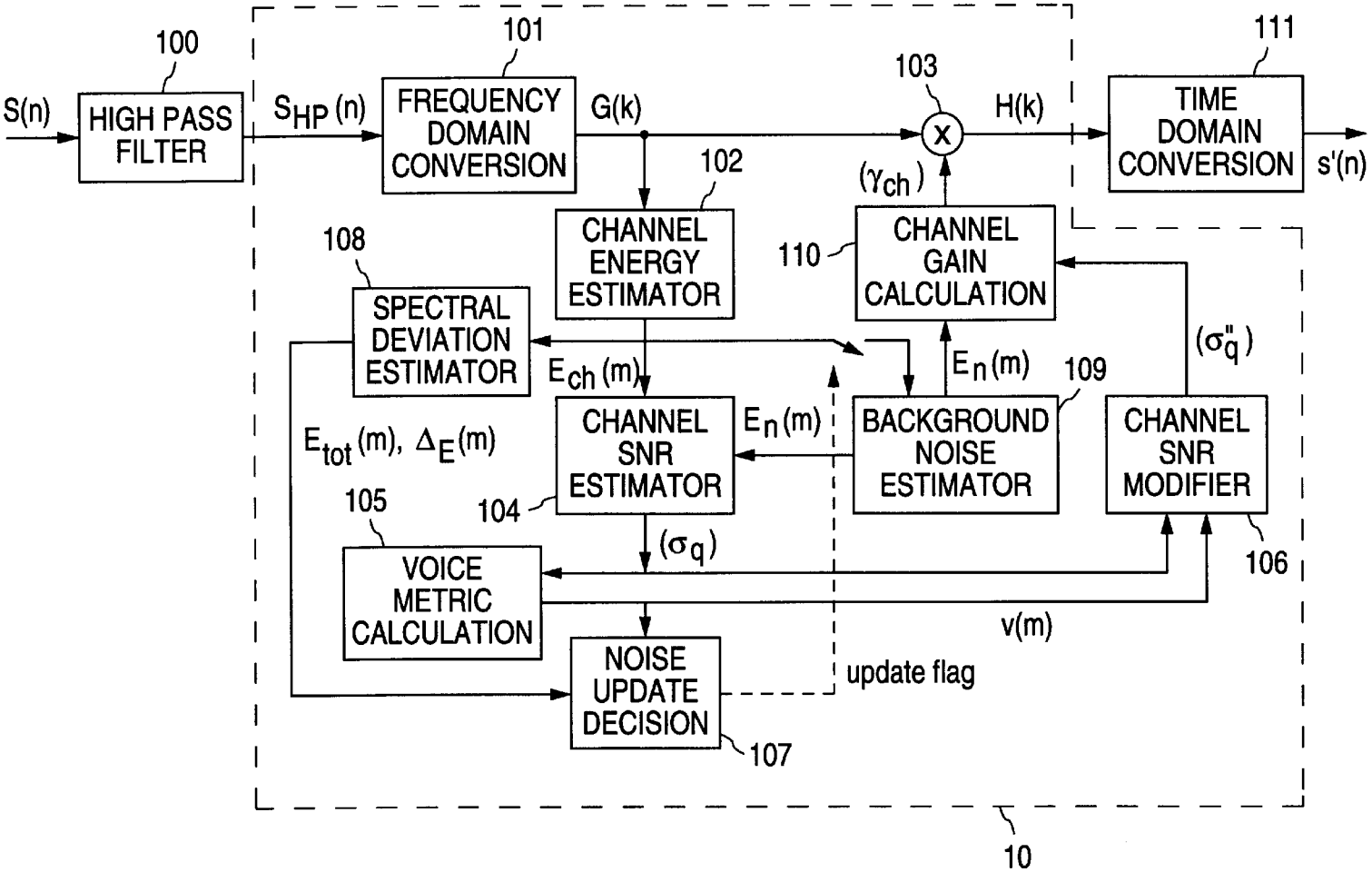
FIGURE 1 (PRIOR ART)
FIG. 1 illustrates a block diagram of a conventional noise reducer.
Figure 1A:
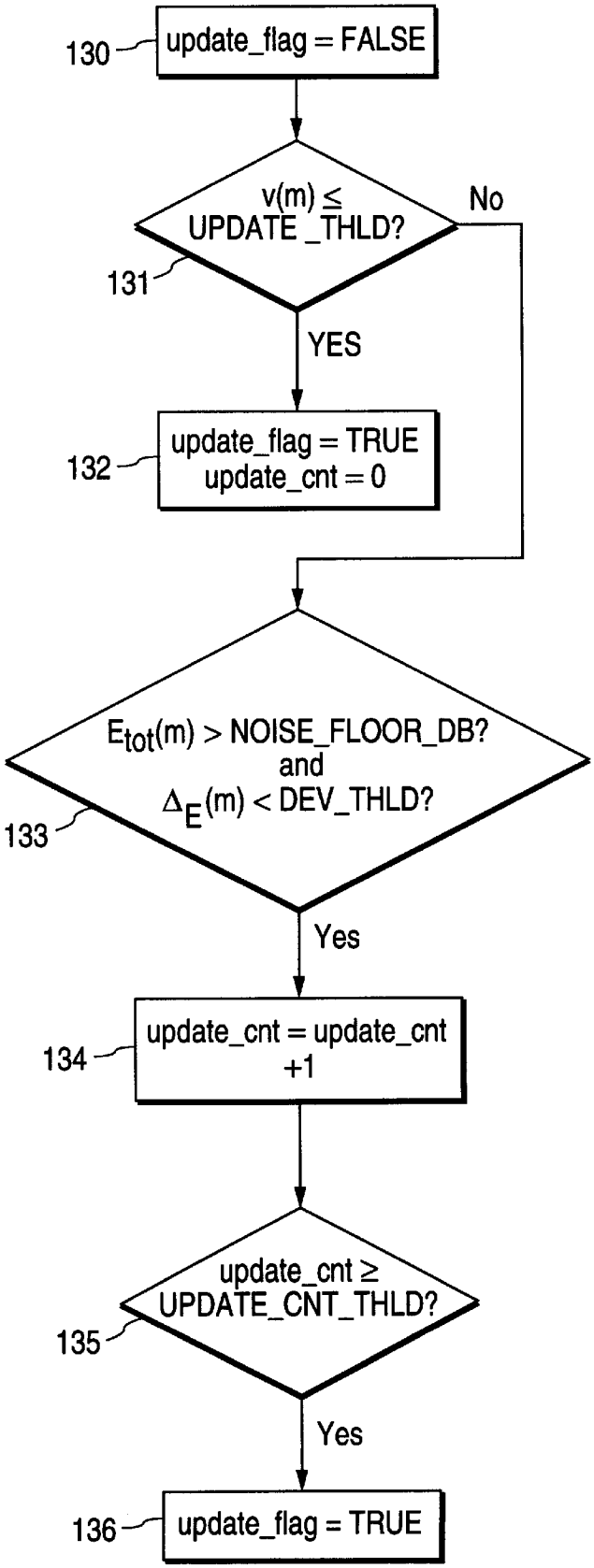
FIGURE 1A (PRIOR ART)
FIG. 1A illustrates a flow chart diagram for updating the noise estimate in the input signal according to the conventional noise reducer of FIG. 1.
Figure 1B:
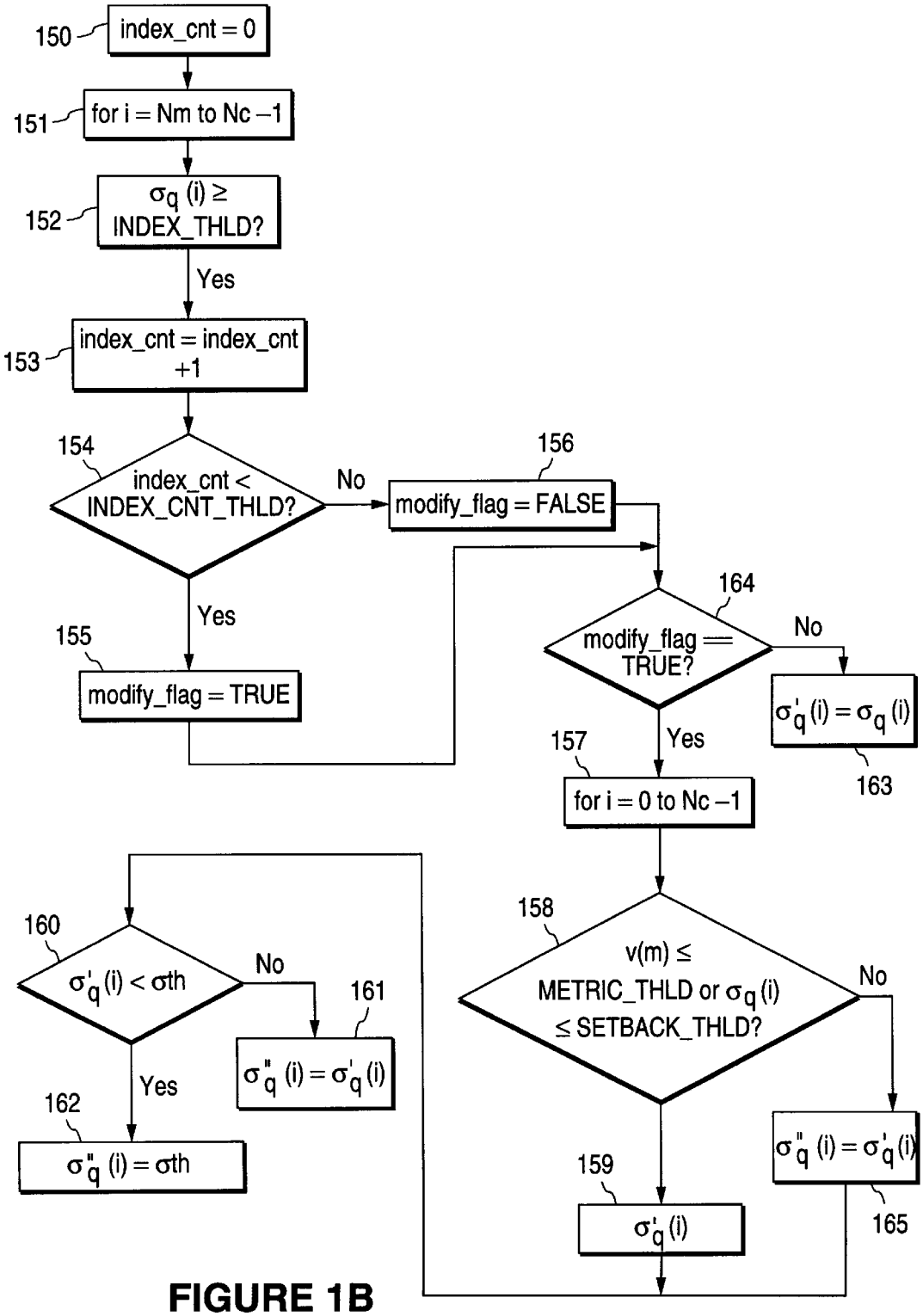
FIGURE 1B (PRIOR ART)
FIG. 1B illustrates a flow chart diagram of channel SNR modification according to the conventional noise reducer of FIG. 1.
Figures 1, 3A:
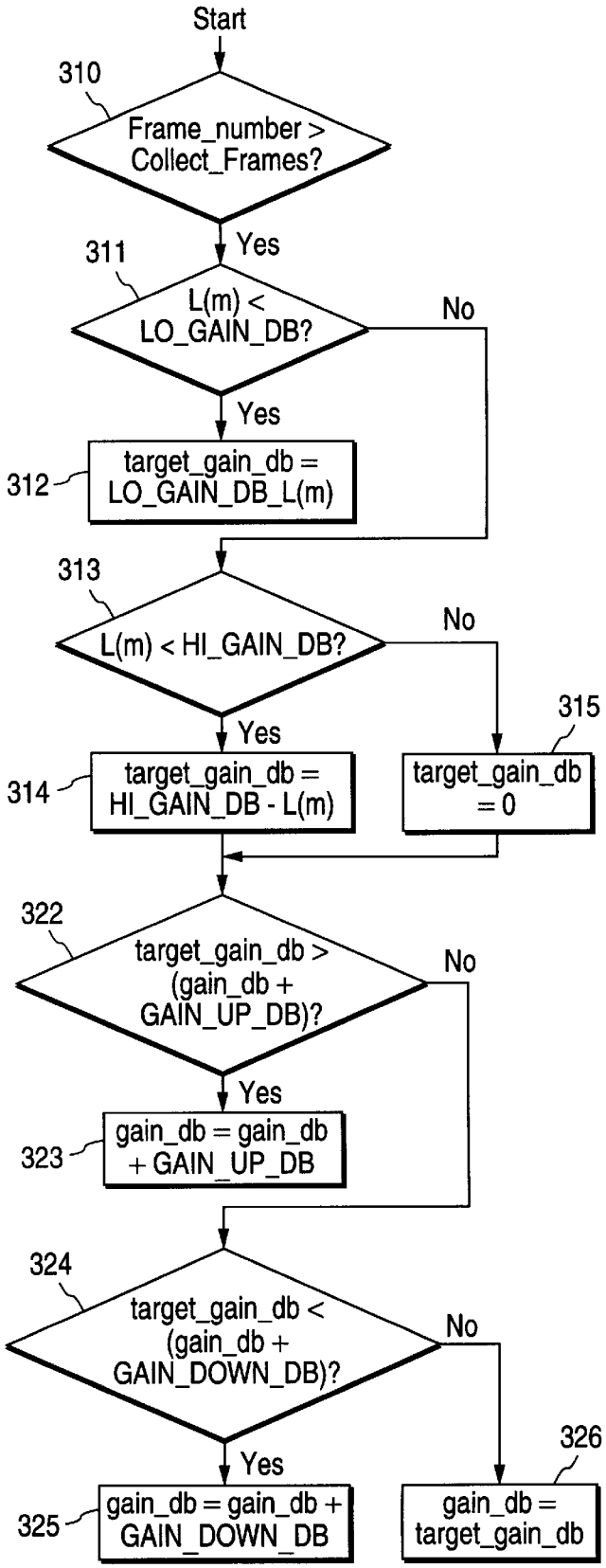
Figures 2, 3A:
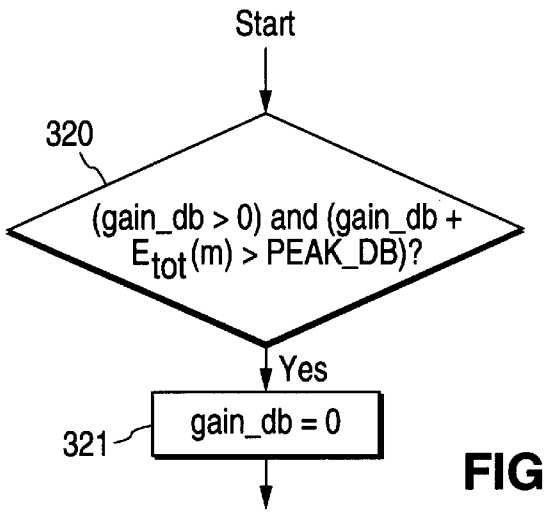

Upon computation of the peak energy $P_{Db}m)$ and the long term energy $L_{Db}(m)$, it is determined whether a sufficient number of frames are accounted for at step 306 by determining whether sufficient signal sample frames are taken to compute and generate the gain control parameters $G_{AGC}(w)$. In other words, it is determined whether a frame number counter (frame_number) exceeds a predetermined number of signal frames (Collect_Frames), set at 500 frames in this embodiment, which indicates a desirable amount of signal frame samples before gain control is executed. For instance, according to this embodiment of the present invention, the preset number of signal frames (Collect_Frames) is set at 500 which is equivalent to 10 seconds of input signal. If the frame counter (frame_number) exceeds this value, then a current gain factor is computed and limited at step 307 as illustrated in FIG. 3A-1.

At step 310, it is determined whether the frame number counter (Frame_number) is larger than the predetermined frame number level (Collect_Frames). Then it is next determined whether the desired gain modification level is high, low, or not required at all. More specifically, at step 311, it is determined whether the long term energy $L_{Db}(m)$ is larger than a predetermined lower gain limit (LO_GAIN_DB). If so, at step 312, a desired gain modification level (target_gain_db) is set to the predetermined lower gain limit (LO_GAIN_DB) minus the long term energy $L_{Db}(m)$ where the predetermined lower gain limit (LO_GAIN_DB) is set at 56 decibels in this embodiment. If, on the other hand, the long term energy is not greater than the predetermined lower gain limit (LO_GAIN_DB), at step 313, it is further determined whether the long term energy $L_{Db}(m)$ is less than a predetermined upper gain limit (HI_GAIN_DB), in which case, at step 314, the desired gain modification level (target_gain_db) is set to the upper gain limit (HI_GAIN_DB) minus the long term energy $L_{Db}(m)$. In the present embodiment, the predetermined upper gain limit (HI_GAIN_DB) is set at 64 decibels. If it is determined that the long term energy $L_{Db}(m)$ is not less than the upper gain limit (HI_GAIN_DB) at step 313, then, the desired gain modification level (target_gain_db) is set to zero at step 315 indicating that signal gain modification is not necessary. In this manner, it is determined whether the gain level of each of the signal frame m needs to be adjusted.

As described above, the long term energy $L_{Db}(m)$ is first compared with the two predetermined gain thresholds, (LO_GAIN_DB) and (HI_GAIN_DB). Through the comparison, the targeted gain adjustment level (target_gain_db) can be determined. Specifically, if the long term energy $L_{Db}(m)$ is higher than the predetermined upper gain limit (HI_GAIN_DB), then the target gain modification level (target_gain_db) will be positive. If, on the other hand, the long term energy $L_{Db}(m)$ is smaller than the predetermined lower gain limit (LO_GAIN_DB), then the target gain modification level (target_gain_db) will be negative, indicating gain attenuation. If the long term energy $L_{Db}(m)$ is in between the predetermined upper and lower gain limits (HI_GAIN_DB), (LO_GAIN_DB), then the target gain modification level (target_gain_db) is set to zero indicating that no gain adjustment is necessary.

If at step 322 the desired gain modification level (target_gain_db) is larger than the sum of the current frame gain level (gain_db) and a predetermined upper gain limit (GAIN_UP_DB) set at 0.005 decibels, the predetermined upper gain limit (GAIN_UP_DB) is added to the current frame gain level (gain_db) at step 323. Otherwise, it is determined at step 324 whether the desired gain modification level (target_gain_db) is less than the sum of the current frame gain level (gain_db) and a predetermined lower gain limit (GAIN_DOWN_DB) which is set at −0.005 decibels. If it is indeed less, the predetermined lower gain limit (GAIN_DOWN_DB) is added to the current frame gain level (gain_db) at step 325. Otherwise, the current frame gain level (gain_db) is set to the desired gain modification level (target_gain_db) at step 326.

To limit the gain, the current frame gain level (gain_db) is first compared to a predetermined upper gain level boundary (MAX_GAIN_DB) of 12 decibels. Then, the lesser of the two is selected as the current frame gain level (gain_db). Also, the current frame gain level (gain_db) is compared with a predetermined lower gain boundary (MIN_GAIN_DB) of −12 decibels and the larger of the two is selected as the current frame gain level (gain_db).

FIG. 3A-2 illustrates gain overflow prevention when low signal is followed by a loud signal. At step 320, it is determined whether the gain level of the previous frame (m−1) is larger than zero and whether the sum of the previous frame gain level and the total channel energy $E_{TOT}(m)$ of the current frame m from the noise reducer 201 (FIG. 2) is larger than a predetermined peaking level (PEAK_DB) which is set at 73 decibels. If so, at step 321, the current frame gain level (gain_db) is initialized to zero, indicating that no gain overflow is necessary.

As can be seen, the frame gain level (gain_db) is the final output of the gain adjustment. At the start of each AGC routine, the routine contains the gain value from the previous frame (m−1). And, at the end of the AGC routine, it has the value of the final gain adjustment which will be applied to the current frame (m).

Once the target gain modification level (target_gain_db), which can either be a gain or an attenuation, is determined, the frame gain level (gain_db) is updated very slowly to avoid sudden gain change between successive frames. The gain change can be positive or negative depending upon the value of the target gain modification level (target_gain_db) which itself, can be either positive or negative. A positive target gain modification level (+target_gain_db) means that a gain will be applied to the current signal frame, while a negative target gain modification level (−target_gain_db) means that an attenuation will be applied to the current signal frame.

Referring back to FIG. 3, having computed and limited the current gain factor at step 307, the frame number m is increased and the initialization variable is set such that further initialization is not necessary (first_time=False) at step 308. Also, at step 306, if insufficient number of frames are accounted for, then at step 308, the frame number is increased and the initialization variable determines that initialization is not necessary (first_time=False). Then, the gain is modified at step 309.

It should be noted that if at step 302, the noise frame indicator indicates a noise frame (i.e., update_flag is not False), then the gain is modified at step 309 bypassing the gain computation stages. The gain is first converted to a linear scale, and then applied to the noise reduced signal $S_1(w)$, generating the noise reduced gain control modified spectrum $S_2(w)$. The linear scale conversion is done according to the following expression.

$$\text{gain}=10^{(gain_db/20)} \tag{3}$$

Subsequent to the linear scale conversion and application to the input spectrum data of the gain control 203 (FIG. 2), the calculated gain according to Equation (3) is interpolated to generate the gain control parameters $G_{AGC}(w)$ and applied to the input spectrum $S_1(w)$. The interpolation and application of the gain control parameters $G_{AGC}(w)$ to the input spectrum $S_1(w)$ can be expressed by the following equations.

$$G_{AGC}(w)=\text{gain}; \tag{4}$$

for all frequency spectrum w $$S_2(w)=G_{AGC}(w) * S_1(w) \tag{5}$$

Thereafter, having modified the gain at step 309, the steps 302 to 308 are repeated for the subsequent signal frame (m+1).

The main task of the gain control is to monitor and compensate for the overall gain variations of the input signal to a desired level. In a practical environment, input gain variations occur for a variety of reasons. For example, variations in each user's voice characteristics, microphone characteristics, change in the distance between user's mouth to the microphone, surrounding noise, and nonlinearity of the analog circuit are some factors which attribute to the fluctuation in the gain of the signal.

Therefore, The gain control according to the present invention compensates for such fluctuation in the strength of the signal. As illustrated, the determination as to whether a speech signal level need to be amplified or attenuated is achieved by estimating the current input energy with respect to a given threshold, thereby setting an appropriate gain value. This process of sharing speech parameters with the noise reducer 201 avoids additional processing.

Figure 4:
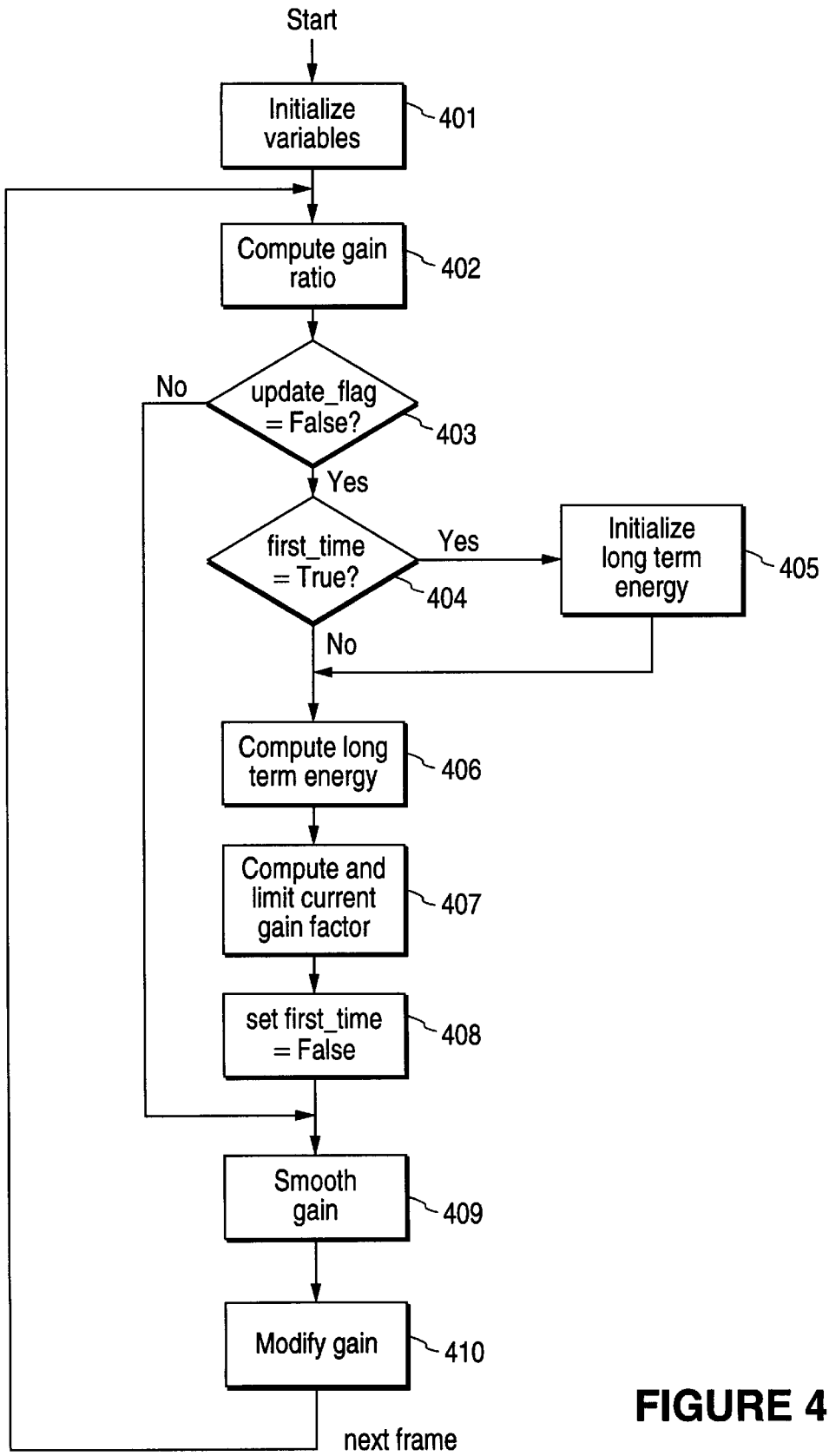
FIG. 4 illustrates a flow chart of the adaptive equalizing system in the noise reducing system of FIG. 2 according to the present invention.

FIG. 4 illustrates a block diagram for the adaptive equalizer 202 of FIG. 2. The adaptive equalization can be described as follows. First, at step 401, equalizer parameters are initialized. Then, a gain ratio G(m,i) is computed at step 402 according to the following expression.

$$G(m,i)=E(m,i)-E_{TOT}(m) \tag{6}$$

Where the current channel energy E(m,i) and the current total channel energy $E_{TOT}(m)$ are determined by the noise reducer 201 (FIG. 2).

Thereafter, it is determined whether or not a noise frame is detected at step 403 (i.e., whether update_flag=False). If the noise frame indicator (update_flag) indicates a signal frame, it is further determined whether the initialization variable (first_time) indicates that initialization is necessary (i.e., whether first_time=True). In other words, it is determined whether the frame of the input signal spectrum detected is the first frame of the input signal.

If at step 403 the noise frame indicator does indicate a noise frame (i.e., update_flag=True), then the gain is smoothed at step 409 as will be explained below. If the initialization variable determined that initialization is necessary such that the detected frame is the first frame of the input signal (i.e., first_time=True), then at step 405, a long term energy T(m,i) is initialized to the gain ratio G(m,i) computed at step 402. Thereafter, at step 406, the long term energy T(m,i) is computed according to the following expression.

$$T(m,i)=\alpha*T(m,i)+(1-\alpha)*G(m,i) \tag{7}$$

Where $\alpha$ is an equalizer smoothing factor set at 0.995 for the present embodiment.

If the initialization variable does not indicate that initialization is necessary (i.e., first_time is not true) at step 404, the above computation of the long term energy T(m,i) is carried out at step 406. Upon determining the long term energy T(m,i), the current gain factor is computed and limited at step 407.

Figure 4A:
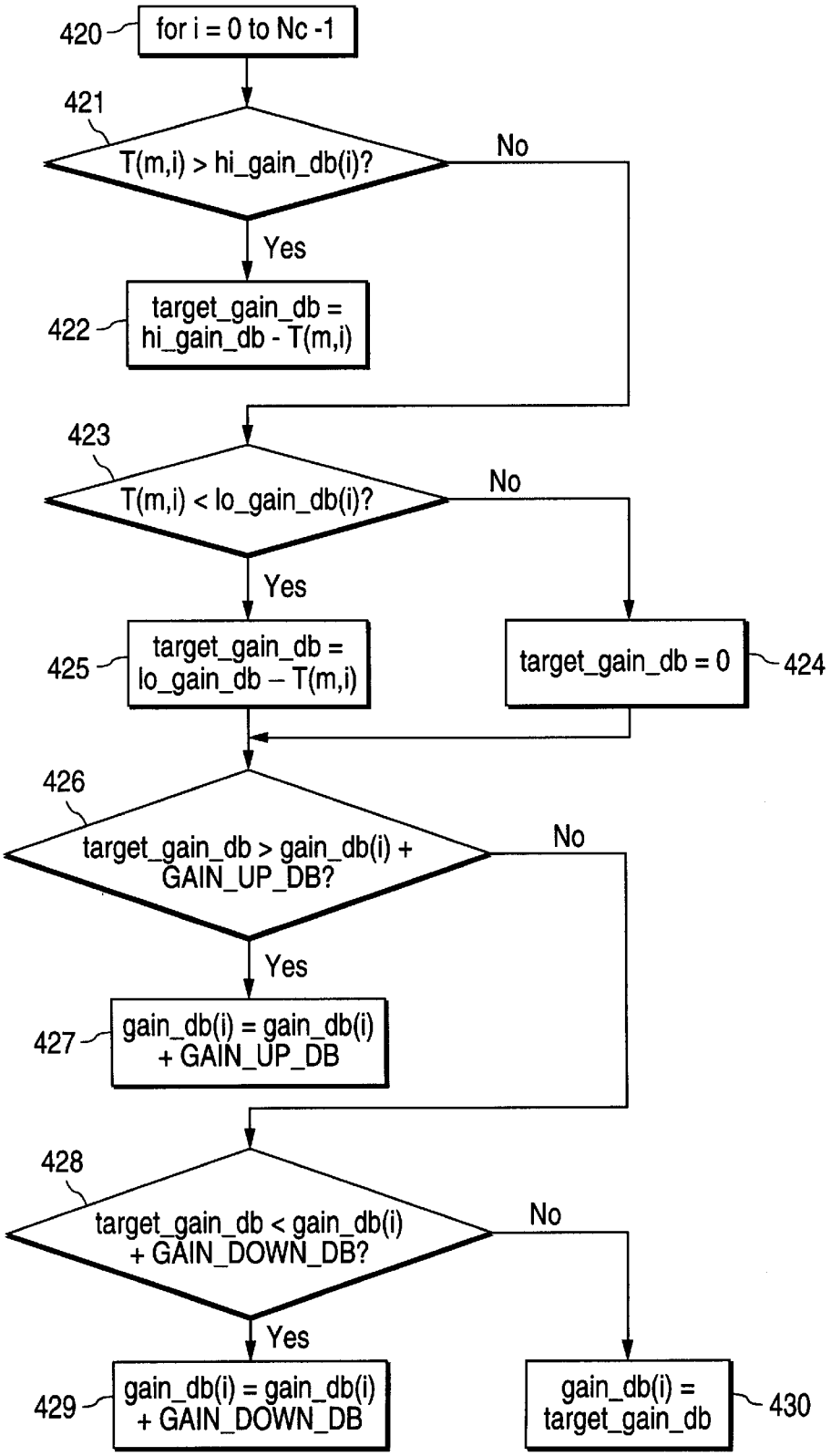
FIG. 4A illustrates a flow chart of the gain factor computation of the adaptive equalizing system of FIG. 4

FIG. 4A illustrates the steps for determining the gain factor. For each channel frequency index i ranging from 0 to (Nc−1), it is determined whether the long term energy T(m,i) is larger than a predetermined targeted high gain ratio (hi_gain_db(i)) at step 421. Then, the desired gain level (target_gain_db) is set to the predetermined targeted high gain ratio (hi_gain_db(i)) minus the long term energy T(m, i) at step 422. Otherwise, at step 423, it is determined whether the long term energy T(m, i) is less than a predetermined targeted lower gain ratio (lo_gain_db(i)). If so, the desired gain level (target_gain_db) is set to the predetermined targeted lower gain ratio (lo_gain_db(i)) minus the long term energy T(m, i) at step 425. Otherwise, the desired gain level (target_gain_db) is set to zero at step 424.

At step 426, it is determined whether the desired gain level (target_gain_db) is larger than the sum of the gain (gain_db(i)) and a predetermined upper gain limit (GAIN_UP_DB) for each channel frequency, where the upper gain limit is set to 0.003 for the present embodiment. If the desired gain level (target_gain_db) is larger than the sum of the gain (gain_db(i)) and a predetermined upper gain limit (GAIN_UP_DB) for each channel frequency, the predetermined upper gain limit (GAIN_UP_DB) is added to the gain (gain_db(i)+GAIN_UP_DB) at step 427.

On the other hand, if the desired gain level (target_gain_db) is not larger than the sum of the gain (gain_db(i)) and a predetermined upper gain limit (GAIN_UP_DB) for each channel frequency, it is determined whether the desired gain level (target_gain_db) is less than the gain (gain_db(i)) and a predetermined lower gain limit (GAIN_DOWN_DB) set at −0.003 for this embodiment at step 429. If so, the predetermined lower gain limit (GAIN_DOWN_DB) is added to the gain (gain_db(i)) at step 429. Otherwise, the gain (gain_db(i)) is set to the desired gain level (target_gain_db) at step 430.

Again, to limit the gain, the (gain_db(i)) is compared to an upper gain boundary (MAX_GAIN_DB) which is set to 6 decibels in this embodiment, and the larger of the two is determined to be the gain (gain_db(i)). Also, the gain (gain_db(i) is compared with a lower gain boundary (MIN_GAIN_DB) set at −6 decibels for the present embodiment, and the larger of the two is chosen as the gain level (gain_db(i)) for that channel frequency. In the present embodiment, the predetermined upper gain level (MAX_GAIN_DB) is set to 6 and the predetermined lower gain level (MIN_GAIN_DB) is set to −6.

It should be noted that the predetermined targeted upper and lower gain ratios, (hi_gain_db) and (lo_gain_db) respectively, are given as follows.

hi_gain_db(i)={−9.0, −9.0, −9.5, −10.5, −12.5, −14.5, −15.5, −15.0, −14.0, −14.5, −17.5, −18.0, −17.0, −18.0, −20.0, −23.0} lo_gain_db(i)={−13.0, −13.0, −13.5, −14.5, −16.5, −18.5, −19.5, −19.0, −18.0, −18.5, −21.5, −21.0, −22.0, −24.0, −27.0}

The steps described above to determine the gain (gain_db (i)) is similar to that for the AGC except that for the AEQ, the gain computation is carried out for each of the 16 frequency bands.

Referring back to FIGS. 4 and 4A, having computed and limited the current gain factor at step 407, the initialization variable (first_time) is set to false at step 408. Then, at step 409, gain changes of the input signal frequency spectrum are smoothed out at each of the 16 frequency channel indices. This is achieved by averaging the current gain of each frequency according to the following expression.

$$\text{gain_}db(i)=\beta*\text{gain_}db(i-1)+(1-(2*\beta))\text{gain_}db(i)+\beta*\text{gain_}db(i+1) \quad (8)$$

For the channel frequency index i=1 to Nc−2, and where an equalizer smoothing factor β is set at 0.02 for this embodiment.

Having smoothed out the gain changes of the input signal frequency spectrum, the gain is modified at step 410. This is achieved by converting the gain (gain_db) to a linear scale in by performing inverse logarithmic function of base 10 ($10^{(gain_db(i)/20)}$) for each of the 16 frequency channel indices (i). Then, the gain(i) is interpolated to generate the adaptive equalizer parameters $G_{AEQ}(w)$, which is then applied to the input spectrum $S_2(w)$ according to the following expressions.

$$G_{AEQ}(w)=\text{gain}(i) \quad (9)$$

$$S_3(w)=G_{AEQ}(w) * S_2(w) \quad (10)$$

Where, for equation (9), $f_L(i) \leqq w \leqq f_H(i)$; and $0 \leqq i \leqq Nc$, and where $f_L(i)$ and $f_H(i)$ are frequency quantization tables used in the noise reducer, i.e., the i-th elements of the respective low and high channel combining tables, which are defined in the IS-127 voice compression standard as follows.

$f_L(i)$={2, 4, 6, 8, 10, 12, 14, 17, 20, 23, 27, 31, 36, 42, 49, 56}, $f_H(i)$={3, 5, 7, 9, 11, 13, 16, 19, 22, 26, 30, 35, 41, 48, 55, 63}.

In the above-described manner, the adaptive equalizer 202 (FIG. 2) compensates for the variation in the user's voice including pitch differences between a male and a female voice. In addition, the adaptive equalizer 202 compensates for any change in the frequency characteristics of the voice signal due to the microphone or internal system itself. Specifically, the adaptive equalizer 202 modifies the gain of each band independently to achieve the desired frequency responses. Similar to the gain control 203, the adaptive equalizer 202 uses the noise reducer parameters to determine when the adjustment is necessary. Then, the adaptive equalizer 202 modifies the frequency spectrum of the input signal.

Figure 5:
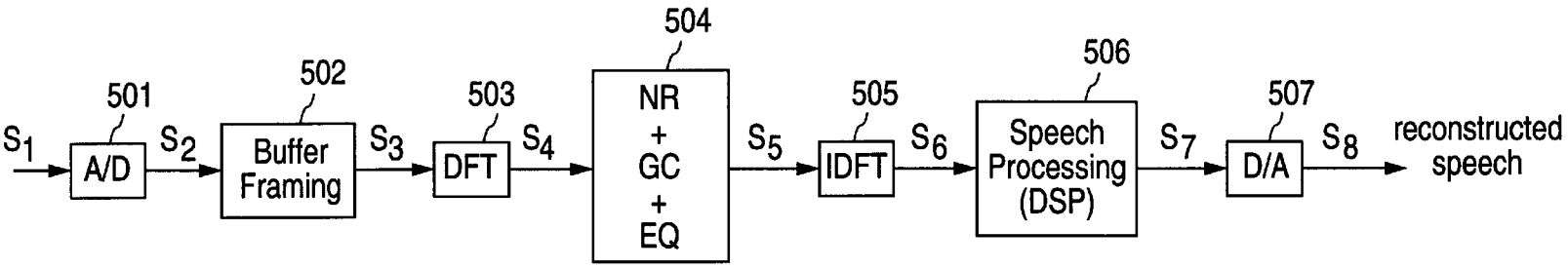
FIG. 5 illustrates a block diagram of a speech Codec system according to the present invention implementing the noise reducing system of FIG. 2.

FIG. 5 illustrates a block diagram of a speech Codec system according to the present invention including the adaptive equalizer 202 and the automatic gain control 203. More particularly, an analog-to-digital converter 501 converts original analog speech signal $S_1$ to digitized speech signal $S_2$. Then, a buffer framing 502 buffers the digitized speech signal $S_2$ into a particular buffer size, for example, 10 ms, 20 ms, etc., to obtain buffered digital speech signal $S_3$. Thereafter, discrete fourier transform processing is performed by a Discrete Fourier Transform (DFT) 503 upon the buffered digital speech signal samples $S_3$ in time domain, resulting in frequency domain speech signal samples $S_4$.

In the frequency domain, speech signal samples $S_4$ is processed by the noise reducing system 504 where the above-described automatic gain control, adaptive equalization, and noise reduction are performed upon the signal samples $S_4$. The resulting speech signal $S_5$ is thereafter reverse processed. In other words, inverse discrete fourier transform processing is performed upon the processed speech signal $S_5$ by an Inverse Discrete Fourier Transform 505 resulting in time domain processed speech signals $S_6$. Then, the time domain processed speech signals $S_6$ are processed by a Codec 506 (for example, a Digital Signal Processor) where the resulting signal $S_7$ is converted into an analog processed speech signal $S_8$ by a digital-to-analog converter 507. In this manner, the noise reduced speech signals are reconstructed and outputted for further processing, amplification, transmission and the like.

According to the present invention, sufficient level of background noise is attenuated while maintaining the original speech characteristics. For example, in a very quiet surrounding, the noise reduction effect is very minimal because of insignificant level of background noise as compared to the signal level itself. By contrast, where there is a high level of background noise, the noise reduction is raised to its maximum value without deteriorating the quality of the original speech. The speech and noise levels of the input signal determine the necessary amount of noise reduction, and the noise reduction variables are changed for each condition.

In the manner described above, the present invention allows substantial reduction in undesirable noise components of speech signals in speech processing techniques and apparatuses without necessitating added hardware, complexity, or sacrifice in speech signal integrity. In particular, as described above, according to the present invention, background noise is reduced by means of frequency transformation and modification thus greatly enhancing speech quality without significantly affecting the reconstructed speech. By estimating the noise spectrum continuously from the input signal, the present invention permits modification of the frequency response of the input signal thus reducing the effect of the noise components of the input signal.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. A method of controlling the gain of an input signal in a signal pre-processing system in accordance with a plurality of parameters generated from a noise reducer in the signal pre-processing system, the method comprising the steps of:

detecting a signal frame;

detecting a first frame of the input signal frequency spectrum;

initializing a plurality of gain control variables after the first frame detecting step;

determining an input signal energy level;

adjusting a gain modification level in accordance with the input signal energy level;

limiting the input signal gain in accordance with a predetermined upper gain level boundary and a predetermined lower gain boundary;

comparing the gain modification level to an upper gain limit and a lower gain limit; and adjusting the input signal frame gain level in accordance with the gain modification level comparing step such that the gain modification level is maintained within a variable range.

2. The method of claim 1 wherein the plurality of gain control variables for initialization includes an input signal peak energy level and an input signal long term energy level.

3. The method of 2 wherein the step of determining the input signal energy level comprises:

adjusting the input signal peak energy level in accordance with a predetermined smoothing factor; and adjusting the input signal long term energy level in accordance with the input signal peak energy and level the predetermined smoothing factor.

4. The method of 3 wherein the predetermined smoothing factor varies in accordance with the total channel energy as determined by the noise reducer such that for the total channel energy being less than the input signal peak energy, the predetermined smoothing factor equals an upper energy level, and for the total channel energy greater or equal to the input signal peak energy, the predetermined smoothing factor equals a lower energy level.

5. The method of claim 3 wherein the upper energy level of the predetermined smoothing factor equals 0.995 and the lower energy level of the predetermined smoothing factor equals 0.5.

6. The method of claim 1 wherein the step of initializing the plurality of variables includes setting the plurality of variables to a total channel energy level determined by the noise reducer.

7. The method of claim 3 wherein adjusting gain modification level includes comparing the input signal energy level in accordance with a predetermined gain range with an upper and a lower limit such that for the input signal energy level higher than the predetermined gain range lower limit the gain modification level is equal to the predetermined gain range lower limit minus the input signal energy level, for the input signal energy level less than the predetermined gain range upper limit, the gain modification level is equal to the predetermine gain range upper limit minus the input signal long term energy, and for the input signal energy level not less than the predetermined gain range upper limit, the gain modification level is equal to zero.

8. The method of claim 7 wherein the upper limit of the predetermined gain range is 64 decibels and the lower limit of the predetermined gain range is 56 decibels.

9. The method of claim 1 wherein the upper gain limit is the sum of the input signal gain and an upper gain level and wherein the lower gain limit is the sum of the input signal gain and a lower gain level.

10. The method of claim 9 wherein the upper gain level is 0.005 decibels and the lower gain limit is −0.005 decibels.

11. The method of claim 10 wherein adjusting the input signal gain includes adding the upper gain level to the input signal gain for gain modification level larger than the upper gain limit, adding the lower gain level to the input signal gain for gain modification level less than the lower gain limit, and setting the input signal gain frame gain level to the gain modification level for the gain modification level less than the upper gain limit and higher than the lower gain limit such that input signal is prevented from gain overflow.

12. The method of claim 1 wherein the input signal gain limiting step includes the steps of:

comparing the input signal gain to the predetermined upper gain level boundary the predetermined lower gain level boundary;

modifying the input signal gain to the predetermined upper gain level boundary for the input signal frame gain level higher than the predetermined upper gain level boundary and to the predetermined lower gain level boundary for the input signal frame gain level lower than the predetermined lower gain level boundary.

13. The method of claim 1 wherein the predetermined upper gain level boundary is 12 decibels and the predetermined lower gain boundary is −12 decibels.

14. The method of claim 13 wherein the variable range in the input signal gain limiting step is determined by the upper and the lower gain level boundary.

15. A method of selectively adjusting the gain of an input signal frequency spectrum for each input signal channel frequency index such that the input signal is adaptively equalized in accordance with a plurality of parameters generated from a noise reducer in a signal pre-processing system, the method comprising the steps of:

initializing a plurality of equalizer variables;

determining a gain ratio for each channel frequency index of the input signal in accordance with the plurality of parameters generated from the noise reducer;

detecting a signal frame;

detecting a first frame of the input signal;

determining an input signal energy level in accordance with a predetermined smoothing factor and the gain ratio;

adjusting a gain factor in accordance with the input signal energy level;

limiting the gain factor in accordance with a predetermined upper gain limit and a predetermined lower gain limit such that the gain factor is limited within a variable range.

16. The method of claim 15 wherein the step of gain ratio determination includes subtracting the total channel energy from the channel energy of the input signal frequency spectrum for each channel frequency index.

17. The method of claim 15 wherein the predetermined smoothing factor in the step of determining the input signal energy level is 0.995.

18. The method of claim 15 wherein the step of adjusting the gain factor includes the steps of:

comparing the input signal energy level to a plurality of predetermined targeted gain ratios;

adjusting the gain modification level for each channel frequency of the input signal frequency spectrum in accordance with a predetermined upper gain boundary and a predetermined lower gain boundary.

19. The method of claim 18 wherein the predetermined upper gain boundary is 0.003 and the predetermined lower gain boundary is −0.003.

20. The method of claim 15 wherein the predetermined upper gain limit 6 and the predetermined lower gain limit is −6.

21. A signal pre-processing system for controlling gain of an input signal in a signal pre-processing system in accordance with a plurality of parameters generated from a noise reducer in the signal pre-processing system, the gain controller comprising:

a noise frame detector for detecting a noise frame in the input signal;

a signal frame detector for detecting a first signal frame of the input signal in accordance with the noise frame detector detecting the noise frame, the signal frame detector further initializing a plurality of gain controller parameters;

a signal energy detector for detecting an input signal energy level in accordance with the signal frame detector detecting the first signal frame the plurality of parameters from the noise reducer and a gain controller smoothing factor such that the signal energy level is adjusted;

a signal frame counter for controlling the signal frame detector; and a gain modifier for generating an input signal gain modification level in accordance with the plurality of parameters from the noise reducer and the signal frame counter detecting a predetermined number of signal frames such that a gain modification level is generated.

22. The signal pre-processing system of claim 21 wherein the signal frame detector initializes the plurality of gain controller parameters based upon the plurality of noise reducer parameters of the signal pre-processing system.

23. The signal pre-processing system of claim 22 wherein the plurality of gain controller parameters include input signal peak energy and input signal long term energy.

24. The signal pre-processing system of claim 21 wherein the gain controller smoothing factor comprises an upper and a lower boundary.

25. The signal pre-processing system of claim 24 wherein the upper boundary of the smoothing factor is 0.995 and the lower boundary of the smoothing factor is 0.5.

26. The signal pre-processing system of claim 21 wherein the predetermined number of signal frames in the gain modifier is 500.

27. The signal pre-processing system of claim 21 wherein the gain modifier generates the input signal gain modification level in accordance with the plurality of parameters from the noise reducer and the signal frame counter detecting a predetermined number of signal frames.

28. A signal pre-processing system for selectively adjusting the gain of an input signal frequency spectrum such that the input signal is adaptively equalized in accordance with a plurality of parameters generated from a noise reducer in the signal transmitting and receiving system, the adaptive equalizer comprising:

a noise frame detector for detecting a noise frame in the input signal;

a signal frame detector for detecting a first input signal frame in accordance with the noise frame detector detecting a noise frame in the input signal and further, the signal frame indicator further initializing a plurality of equalizer parameters;

a signal energy detector for detecting an input signal energy level in accordance with the signal frame detector; and a gain equalizer for generating an equalization level of the input signal in accordance with the plurality of parameters from the noise reducer and the signal energy detector detecting an input signal energy level such that the gain equalization level is generated.

29. The signal pre-processing system of claim 28 wherein the signal frame detector initializes the plurality of adaptive equalizer parameters based upon the plurality of noise reducer parameters of the signal pre-processing system.

30. The signal pre-processing system of claim 29 wherein the plurality of adaptive equalizer parameters include an input signal long term energy level.

31. The signal pre-processing system of claim 28 wherein the gain equalizer further smooths out gain changes of the input signal frequency spectrum in accordance with a gain smoothing factor.

32. The signal pre-processing system of claim 31 wherein the gain smoothing factor is 0.002.

* * * * *